United States Patent [19]

McNab et al.

[11] 4,263,967

[45] Apr. 28, 1981

[54] HEAT TRANSFER PACK

[75] Inventors: John L. G. McNab; Malcolm R. W. Heath, both of Marleston, Australia

[73] Assignee: Hayes Timber Pty. Limited, et al., Forrestville, Australia

[21] Appl. No.: 935,897

[22] Filed: Aug. 22, 1978

[30] Foreign Application Priority Data

Aug. 23, 1977 [AU] Australia ..... PD1345

[51] Int. Cl.[3] ..... F28D 9/00

[52] U.S. Cl. ..... 165/166; 29/157.3 D; 165/DIG. 8

[58] Field of Search ..... 165/166, 167, DIG. 8, 165/81; 29/157.3 R, 157.3 D

[56] References Cited

U.S. PATENT DOCUMENTS

| | | | |
|---|---|---|---|
| 2,959,401 | 11/1960 | Burton | 165/166 |
| 3,212,572 | 10/1965 | Otto | 165/166 |
| 3,757,855 | 9/1973 | Kun et al. | 165/166 |
| 3,967,354 | 7/1976 | Jaspers | 165/166 X |
| 4,095,349 | 6/1978 | Parker | 165/166 X |
| 4,116,271 | 9/1978 | De Lepeleire | 165/166 |

FOREIGN PATENT DOCUMENTS

| | | | |
|---|---|---|---|
| 2525921 | 12/1976 | Fed. Rep. of Germany | 165/166 |
| 2630551 | 1/1977 | Fed. Rep. of Germany | 165/166 |
| 2630905 | 1/1978 | Fed. Rep. of Germany | 165/166 |
| 488571 | 7/1938 | United Kingdom | 165/166 |
| 938088 | 9/1963 | United Kingdom | 165/166 |

*Primary Examiner*—Stephen Marcus

*Attorney, Agent, or Firm*—Rummler and Snow

[57] ABSTRACT

A heat exchanger having a number of sheets retained in spaced relationship with one another by projections outstanding from the sheet surfaces. Some at least of the sheets are provided with return flanges and the arrangement is such that return flanges of a sheet lie contiguous with an adjacent sheet so as to define therewith a fluid flow passage. The flanges of the next adjacent sheet are angled with respect to those of the first to define a second passage which extends in a different direction. Two sets of passages are formed thereby and the sheets constitute heat transfer means between adjacent passages. Each set of passages forms a fluid flow conduit. The pack is formed without cementing or welding the sheets together.

11 Claims, 7 Drawing Figures

HEAT TRANSFER PACK

Figure 1:
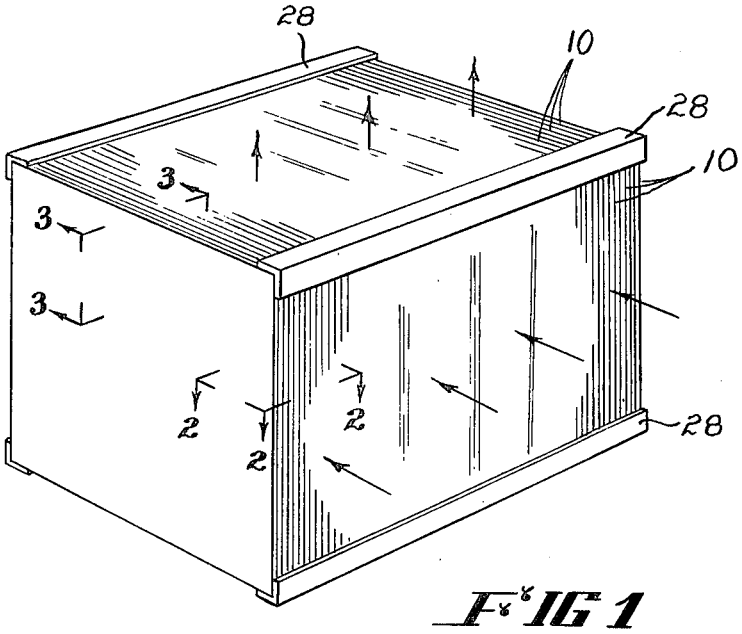

This invention relates to a "pack" (or stack) of sheets of material which, when assembled constitute a heat exchanger for transferring heat from one fluid to another.

BACKGROUND OF THE INVENTION

In air conditioning systems (both heating and cooling) there is usually a need for proportion of fresh air flow, and sometimes for total flow of fresh outside air to be supplied to the conditioned space for ventilation purposes. This is wasteful of energy, and requires the use of larger equipment than is otherwise necessary if an efficient heat exchanger is employed. Also in evaporative air cooling, an objection has been raised against the high humidity which exists when the "conditioned" air contains the moisture of evaporation. To overcome these difficulties it has been proposed to utilise a plurality of parallel spaced plates of imperforate material arranged as a stack, there being closure means between the edges of adjacent plates, the closure means between any pair of adjacent plates being along opposite edges and the closure means between the next pair of adjacent plates also being along opposite but alternate edges, thereby dividing the stack into two multi-cavity conduits, and reference is made to Australian Pat. No. 425,702 standing in the name of Commonwealth Scientific and Industrail Research Organisation. In the waste heat application the incoming fresh air is heated by the exhausting air on one side of the plates of the stack while in the evaporative cooling application, the incoming fresh air is indirectly cooled by evaporatively cooled exhaust air on the other side of the plates of the stack.

One of the difficulties which has been encountered with previous stacks has been the difficulty of joining of the edges of the plates to form the required two conduits. Full sealing by welding is difficult to achieve, and use of adhesives is tedious and often unsatisfactory.

The main objects of this invention are to provide improvements whereby a heat transfer pack is formed simply and at low cost, wherein the spaces between the plates are maintained, and wherein an acceptable "seal" between the two conduits is achieved without welding or adhering the plates or without the use of a separate sealing medium between the plates.

BRIEF SUMMARY OF THE INVENTION

In this invention, instead of the plates which form the two fluid flow conduits being sealingly joined by welding or cementing or other means known in the art, each plate of a plurality of those plates has return flanges which extend along opposite sides and which abut an adjacent plate, the flanges of the adjacent plate being at an angle such that alternate fluid passages combine to form two sets of fluid conduits and the plates constitute heat transfer means between adjacent passages.

It has been found that with this arrangement, minimal leakage (if any) occurs. A small differential in pressure is found to assist the abutting surfaces in contiguity, and it appears that the higher the pressure, the better the seal. The cost of assembly is of course substantially less than if separate welding or cementing of the plates is utilised.

More specifically, the invention consists of a heat transfer pack comprising a plurality of sheets, projections outstanding from at least one side of at least some of the sheets, which said projections function as spacers and maintain the sheets in a spaced parallel array, at least each alternate said sheet having at least one pair of return flanges which extend along respective opposite edges and which abut an adjacent sheet to define therewith a fluid flow passage on one side of that sheet, and being at an angle with respect to the flanges which define a second fluid flow passage on the other side of that sheet, such that alternate said passages combine to form a first fluid flow conduit extending in one direction, the other alternate said passages combine to form a second fluid to flow conduit extending at an angle with respect to the first, and the sheets constitute heat transfer means between adjacent passages.

The projections, in imparting turbulence to the fluid flow through the conduits, reduces laminar flow and improves the heat transfer from the fluid in one of the multi-cavity conduits to the fluid in the other.

In another aspect of the invention there is provided a method of forming a heat transfer pack which comprises forming a strip of material to have a plurality of spaced projections extending from at least one surface thereof, passing the strip through a pair of folding forms and thereby folding at least one pair of parallel strip edges to form return flanges, and positioning the sheets one upon the other with the return flanges separating adjacent sheets to form a plurality of fluid flow passages which define two conduits angled with respect to one another. If the strip is thermoplastic, the folds are sometimes affected by application of heat.

DETAIL DESCRIPTION OF THE DRAWINGS

Figure 2:
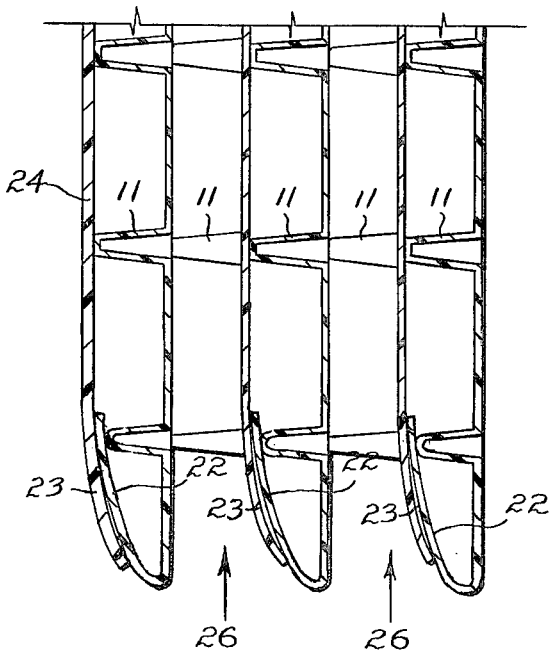
Figure 3:
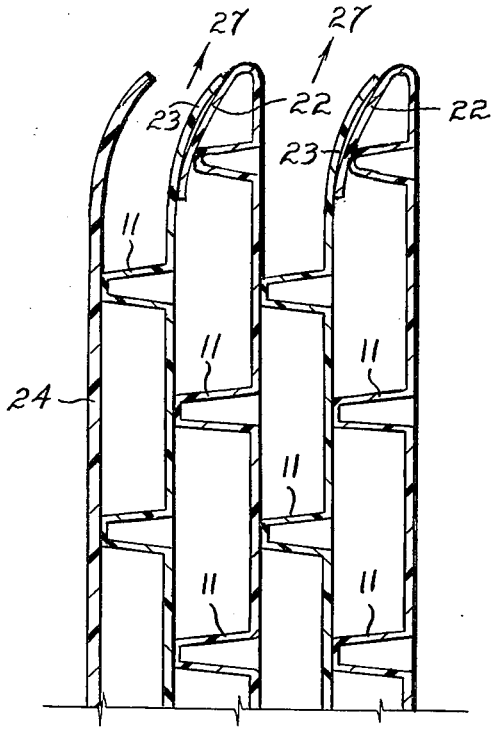
Figure 4:
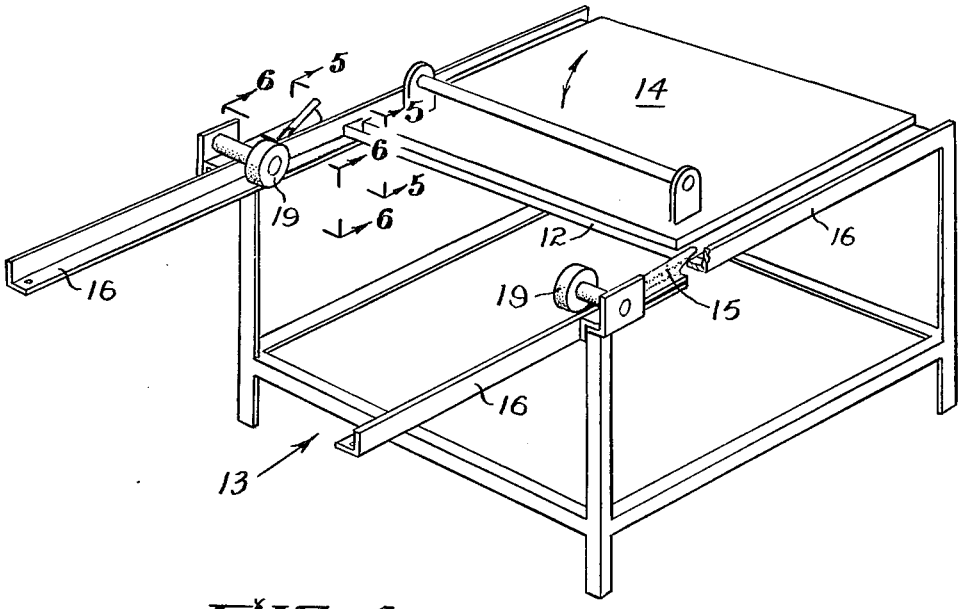
Figure 5:
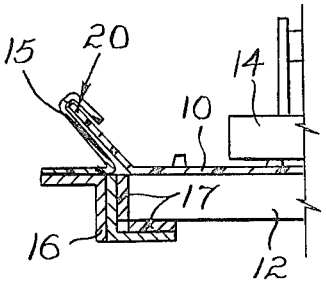
Figure 6:
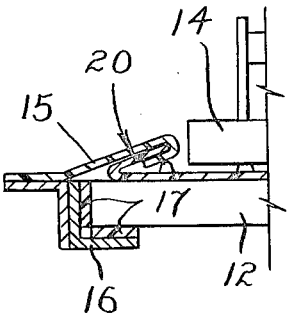
Figure 7:
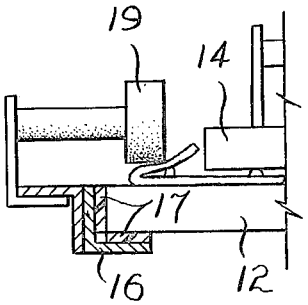

An embodiment of the invention is described hereunder in some detail with reference to and as illustrated in the accompanying drawings, in which:

FIG. 1 is a perspective view of a heat transfer pack,

FIG. 2 is a fragmentary section on plane 2—2—2 of FIG. 1, drawn to an enlarged scale, FIG. 3 is a fragmentary section on plane 3—3—3 of FIG. 1, drawn to an enlarged scale, FIG. 4 is a perspective view of means for folding the edges to form return flanges, FIG. 5 is a fragmentary section on plane 5—5—5 of FIG. 4, drawn to an enlarged scale, FIG. 6 is a fragmentary section on plane 6—6—6 of FIG. 4, drawn to an enlarged scale, and FIG. 7 is a section through a roller.

In this embodiment thin sheets 10 of thermoplastics material which is heat deformable (in this embodiment, polyvinylchloride) are passed through a machine (not shown) which projects heat deformed portions of the sheet upwardly to form a regular pattern of projections 11 extending from one side of the sheet, each projection 11 being generally tubular in shape. A vacuum forming process is utilised herein, but the sheet can also be "hot-pressed" to form the projections 11.

The sheet strip is then clamped on a platen 12 of a machine 13 (FIG. 4) by means of a hinged clamping plate 14, and the edges of the strip are entered into respective folding forms 15. The machine 13 has a pair of spaced angle section runners 16, and the platen 12 is provided with low friction pads 17 which enable it to move along runners 16. Adjacent runners 16 there are also respective folding rollers 19 which co-operate with platen 12 to crease the folded edges and reduce the radius of fold, as shown in FIG. 7. When polyvinylchloride (or metal) is used, cold forming is considered to be sufficient, but if polypropylene is used, then application of heat is usually necessary. This can be radiant heat, or heat from a hot air gun.

Each metal folding form 15 is provided with spaced portions defining a channel 20 a little wider than the sheet thickness, and part helical in shape and extending from being outboard of the strip edge to being inboard. The sheet 10 therefore in being folded has formed along its two longitudinal edges a pair of sloping return flanges 22, one on each edge, each return flange in this embodiment folding over the strip on the same side as the projections 11 which extend upwardly. The outermost projections 11 are less protruberant than the others, and support the flanges 22. The unfolded edges of the sheets 10 are slightly deformed to provide sloping flaps 23 to lie in face to face contact with the outer surfaces of the flanges 22, as shown in FIGS. 2 and 3. An end support sheet 24 is provided and is thicker than the sheets having projections 11 thereon, to provide a degree of stiffness. The sheets 10 are then located one upon the other, the contiguous surfaces being between the outer surface of a return flange 22 and the under surface of the flap 23 of the next adjacent sheet, and the flanges 22 are arranged alternately to extend in different planes, so that the stack which is built up comprises two multi-cavity conduits 26 and 27 which, in this embodiment, extend at right angles to one another. The thin sheets constitute heat transfer means between the conduits 26 and 27 and the turbulence to fluid (liquid, air or other gas) flow caused by the projections breaks up formation of boundary layer laminar flow. Angle corner members 28 provide structural strength and assist in sealing the corners of the sheets 10. The corner members can be, but often need not be sealed in place to the plates using a suitable mastic sealant. The stack can then be inserted in the intercepting zone between two conduits, one conduit conducting fluid at one temperature and the other conduit conducting another fluid at a different temperature, which is to be cooled or warmed by the heat exchanging effect of the pack.

Ideally the return flange folding is left incomplete in the unassembled condition such that when assembled under slight compression with the plates the return flange folds are completed. The folded plate material thus 22 provides a spring effect which assists in the sealing action.

The arrangement is further improved by providing an angled shape to the plate edges 23 which abut the return flanges 22 so that contact of the sealing faces is increased. The resulting shape of the return flange and the abutting face provides a larger opening than would otherwise occur for the fluids to enter and leave the passages and hence there is less resistance to fluid flow.

Despite the absence of welding, adhesion or separate sealing medium the invention provides excellent sealing between the adjacent passages and leakage, if any, is minimal.

By arranging for a differential pressure between the fluids any minor leakage is normally of little consequence as one of the fluids can be kept uncontaminated. In most applications this is quite satisfactory.

Since each return flange extends along the whole edge of the plate there are theoretically no gaps at the corners of the assembly although in practice due to manufacture and assembly tolerances, a small gap occurs. This gap is simply closed if required by applying a small quantity of sealing material on the corners where they are held in a supporting frame or housing.

The above embodiment has been described with respect to tubular projections but may be cone-shaped. The projections can also be extensive in length, for example, rectilinear projections which extend in the direction of gas flow, or slightly inclined thereto for causing turbulence.

If alternate sheets only have projections outstanding therefrom, then the projections must extend from both faces of each of those sheets. In such a construction, it is convenient to have upturned return flanges along one pair of parallel sides, and downturned return flanges along the other pair of parallel sides, and the other group of alternate sheets can be planar, or nearly planar. When assembled, the plates form between them a plurality of fluid flow passages which define two conduits angled with respect to one another. In most instances the conduits will be at right angles, but in some applications they are at an acute angle, the sheets being of parallelogram shape.

In another slight variation, the sheets can be arranged so that one group of alternate sheets has projections thereon, and the other has upturned and downturned flanges thereon.

I claim:

1. In a heat transfer pack comprising a plurality of substantially parallel sheets and spacer means between said sheets for maintaining them in a predetermined spaced relation with each other, alternate ones of said sheets having a pair of return flanges which extend along respective opposite edges of the sheet and abut the facing surface of the next adjacent sheet to define a fluid flow passage between adjacent sheets in a direction generally parallel with the said return flanges, the improvement which comprises forming each return flange to slope inwardly and upwardly to overhang the face of the sheet with its free margin spaced therefrom a greater distance than the height of the adjacent ones of said spacer means, whereby when abutted with the next adjacent sheet and said sheets are in said predetermined spaced relation with each other the free margins of said return flanges resiliently bear against the next adjacent sheet to form a non-interlocked pressure contact with the said adjacent sheet to form an essentially fluid tight seal which is the essential seal between said sheets.

2. A heat transfer pack according to claim 1 wherein each of said adjacent sheets has a pair of inwardly sloping return flanges extending along respective opposite edges of the sheet which are at an angle relative to the return flanges of the first mentioned sheet and which when abutting a facing sheet will provide a second fluid passage directed at an angle relative to the first mentioned flow passage.

3. A heat transfer pack according to claim 1 wherein the abutted portion of each adjacent sheet is sloped inwardly toward the said return flange.

4. A heat transfer pack comprising a plurality of sheets and spacer means between said sheets for maintaining said sheets in spaced parallel array, each alternate sheet having a pair of return flanges extending along respective opposite edges and adapted to abut the surface of an adjacent sheet to define therewith a fluid flow passage on one side of that sheet, a pair of return flanges on the other side of said adjacent sheet extending along respective opposite edges thereof which are at an angle relative to the return flanges of the first sheet, said adjacent sheet return flanges being adapted to abut the surface of a facing sheet to form therewith a second fluid flow passage extending at an angle relative to the first mentioned flow passage, means for holding said array of sheets in tight face to face relation spaced apart by said spacer means, each of said return flanges being folded inwardly from the respectively sheet edge so as to slope away from the face of that sheet and overhang the same with its free margin spaced therefrom a distance greater than the height of the adjacent spacer means whereby when said sheets are held in said face to face relation by said holding means the said return flanges resiliently bear against the abutting surface of the adjacent sheet to form a non-interlocked pressure sealing contact with the respective abutting surfaces to form an essentially fluid-tight seal which is the essential seal between said sheets.

5. A heat transfer pack according to claim 4 wherein the abutted portions of each of said sheets is the marginal edge surface thereof extending at an angle relative to the return flange edges, and each abutted portion is in the form of a rearwardly sloping flap substantially conforming with the slope of the respective return flange.

6. In a heat transfer pack comprising a plurality of substantially parallel sheets and spacer means between said sheets for maintaining said sheets in a predetermined spaced relation with each other, alternate ones of said sheets having a pair of return flanges which extend along respective opposite edges of the sheet and abut the facing surface of the next adjacent sheet to define between them a fluid flow passage in a direction generally parallel with the said return flanges, the improvement which comprises forming each return flange to slope inwardly and upwardly to overhang the face of the sheet with its free margin spaced therefrom a greater distance than the height of said adjacent spacer means, whereby when abutted with the next adjacent sheet and said sheets are in said predetermined spaced relation with each other the free margins of said return flanges resiliently bear against the next adjacent sheet to form a non-interlocked pressure contact with the said adjacent sheet wherein the sheet and the adjacent sheet are able to exhibit relative movement in the area of the pressure contact.

7. In a heat transfer pack comprising a plurality of substantially parallel sheets and means between said sheets for maintaining adjacent sheets in spaced-apart relation to each other, alternate ones of said sheets having a pair of flanges which extend along respective generally opposite edges of the sheet and abut the facing surface of the next adjacent sheet to define a fluid flow passage between adjacent sheets, said passage extending in a direction generally parallel with the said flanges, the improvement comprising resilient sealing means incorporated in said flanges by forming each said flange to slope toward the next adjacent sheet, said flanges extending upward from the face of the sheet before assembly of said pack a distance greater than after said pack is assembled by abuttingly deflecting said flange against said next adjacent sheet to deflect the flange toward the plane of the sheet to which the flange is attached, with the said flanges resiliently bearing against said next adjacent sheet to form a non-interlocked pressure contact with the said adjacent sheet to form an essentially fluid-tight seal which is the essential seal between said sheets.

8. A heat transfer pack comprising a plurality of sheets and means for maintaining said sheets in spaced parallel array, each alternate sheet having a pair of flanges extending along respective opposite edges and adapted to abut the surface of an adjacent sheet to define therewith a fluid flow passage on one side of that sheet, a pair of flanges on the other side of said adjacent sheet extending along respective opposite edges thereof which are at an angle relative to the flanges of the first sheet, said adjacent sheet flanges being adapted to abut the surface of a facing sheet to form therewith a second fluid flow passage extending at an angle relative to the first mentioned flow passage, means for holding said array of sheets in tight face to face spaced apart relation, each of said flanges being folded from the respective sheet edge so as to slope away from the face of that sheet a distance greater than the width of the respective fluid flow passage whereby when said sheets are held in said face to face relation by said holding means the said flanges resiliently bear against the abutting surface of the adjacent sheet and are deflected toward the plane of the sheet to which the said flanges are attached to form a non-interlocked pressure sealing contact with the respective abutting surfaces to form an essentially fluid-tight seal which is the essential seal between said sheets.

9. In a heat transfer pack comprising a plurality of substantially parallel sheets and means between said sheets for maintaining adjacent sheets in spaced-apart relation to each other, alternate ones of said sheets having a pair of flanges which extend along respective generally opposite edges of the sheet and abut the facing surface of the next adjacent sheet to define a fluid flow passage between adjacent sheets, said passage extending in a direction generally parallel with the said flanges, the improvement comprising resilient sealing means incorporated in said flanges by forming each said flange to slope toward the next adjacent sheet, said flanges extending upward from the face of the sheet before assembly of said pack a distance greater than after said pack is assembled by abuttingly deflecting said flange against said next adjacent sheet to deflect the flange toward the plane of the sheet to which the flange is attached, with the said flanges resiliently bearing against a portion of said next adjacent sheet, which portion is not flanged to the same degree as said flanges, to form a pressure contact with the said adjacent sheet to form an essentially fluid-tight seal which is the essential seal between said sheets.

10. A method of forming a heat transfer pack comprising a plurality of spaced substantially parallel sheets defining fluid flow passages therebetween without permanently bonding said sheets to one another, said method comprising providing a plurality of sheets having spacer means associated therewith for maintaining a given sheet in said pack at a predetermined distance from the next adjacent sheet, said sheets having a pair of return flanges extending along respective opposite edges of said sheet and sloping inwardly and upwardly to overhang the face of the sheet with the free margin of the return flanges spaced from the face of the sheet a greater distance than the said predetermined distance, assembling said sheets in abutting pack form wherein alternate sheets have their respective return flanges located on sides which are different than the sides upon which the respective return flanges of adjacent sheets are located, to thereby define at least two fluid flow passages extending through said pack in different directions, and forming an essentially fluidtight seal by placing said sheets said predetermined distance apart by compressing said return flanges to form non-interlocked sealing pressure contact with the next adjacent sheet.

11. A method of forming a heat transfer pack comprising a plurality of spaced substantially parallel sheets defining fluid flow passages therebetween without permanently bonding said sheets to one another, said method comprising providing a plurality of sheets having means associated therewith for maintaining a given sheet in said pack at a predetermined distance from the next adjacent sheets, said sheets having a pair of flanges extending along respective opposite edges of said sheet and sloping upwardly with the flanges spaced from the face of the sheet a greater distance than the said predetermined distance, assembling said sheets in abutting pack form wherein alternate sheets have their respective flanges located on sides which are different than the sides upon which the respective flanges of adjacent sheets are located, to thereby define at least two fluid flow passages extending through said pack in different directions, and forming an essentially fluid-tight seal by placing said sheets said predetermined distance apart by compressing said flanges toward the plane of the sheet to which each flange is attached to form non-interlocked sealing pressure contact with the next adjacent sheet.

* * * * *